US006082071A

United States Patent [19]

Richardson

[11] Patent Number: 6,082,071

[45] Date of Patent: Jul. 4, 2000

[54] CLADDING OF CONSERVATORY ROOF COMPONENTS

[75] Inventor: Christopher Richardson, Clitheroe, United Kingdom

[73] Assignee: Ultraframe (U.K.) Limited of Enterprise Works, United Kingdom

[21] Appl. No.: 09/120,073

[22] Filed: Jul. 21, 1998

[30] Foreign Application Priority Data

Dec. 18, 1997 [GB] United Kingdom ..... 9726716

[51] Int. Cl.[7] ..... E04C 2/38

[52] U.S. Cl. ..... 52/718.04; 52/717.04; 52/DIG. 17; 52/DIG. 8

[58] Field of Search ..... 52/717.04, 717.01, 52/718.04, 737.3, 96, 646, DIG. 17, DIG. 8

[56] References Cited

U.S. PATENT DOCUMENTS

| | | | |
|---|---|---|---|
| 2,668,509 | 2/1954 | Fox-Williams | 52/DIG. 17 X |
| 3,210,808 | 10/1965 | Creager | 52/204.705 |
| 3,964,231 | 6/1976 | Budich et al. | 52/734.1 |
| 4,251,964 | 2/1981 | Francis | 52/DIG. 17 X |
| 4,583,333 | 4/1986 | Minter | 52/DIG. 17 X |
| 4,658,559 | 4/1987 | Doherty | 52/DIG. 17 X |
| 4,671,027 | 6/1987 | Esposito | 52/DIG. 17 X |
| 4,724,646 | 2/1988 | Meyers | 52/DIG. 17 X |
| 4,742,662 | 5/1988 | Smith | 52/DIG. 8 X |
| 4,747,246 | 5/1988 | Sanborn | 52/DIG. 8 X |
| 4,848,053 | 7/1989 | Clausen | 52/DIG. 17 X |
| 4,875,311 | 10/1989 | Meyers | 52/DIG. 17 X |
| 5,007,215 | 4/1991 | Minter | 52/DIG. 17 X |
| 5,265,393 | 11/1993 | Bischel et al. | 52/DIG. 8 X |
| 5,850,717 | 12/1998 | Schiedegger et al. | 52/718.04 X |

FOREIGN PATENT DOCUMENTS

| | | |
|---|---|---|
| 2143570 | 2/1985 | United Kingdom . |
| 91/14060 | 9/1991 | WIPO . |

OTHER PUBLICATIONS

Search Report of UK Patent Office, UK Patent Application No. GB 9826585.3 Date of search Mar. 12, 1999.

*Primary Examiner*—Beth A. Stephan
*Assistant Examiner*—Brian E. Glessner
*Attorney, Agent, or Firm*—Howell & Haferkamp, LC

[57] ABSTRACT

A conservatory roofing system is constructed of a ridge, eaves and glazing bars supporting glazing material between the ridge and eaves. The ridge, eaves and glazing bars are made of structural aluminium components with visible surfaces covered with plastics cladding members. Onto internal surfaces on the plastics cladding members are mounted timber components to give an appearance from the inside that the conservatory is made of timber.

13 Claims, 7 Drawing Sheets

CLADDING OF CONSERVATORY ROOF COMPONENTS

BACKGROUND OF THE INVENTION (1) Field of the Invention

This invention concerns cladding of conservatory roof components.

(2) Description of the Related Art

Many conservatories are constructed from aluminium structural elements and clad with u-PVC components either in white or brown with a wood grain effect. There is, however, a demand for conservatories constructed of wood, typically of a hard wood such as mahogany, but, such conservatories are far more expensive. Therefore, the present invention proposes using standard aluminium/u-PVC components for constructing a conservatory and cladding such components, as necessary, with timber to give the impression at least from the inside that the conservatory is constructed of wood.

Because conservatories can be made to different styles and with different roof pitches the number of wooden cladding components required would be very high and hence costs would be high. There is, therefore, a need to standardise on components as much as possible to facilitate construction of a conservatory and to keep costs down.

SUMMARY OF THE INVENTION

According to the invention there is provided a conservatory roofing system comprising a ridge, eaves and glazing bars supporting glazing material between the ridge and eaves, wherein one or more of internal surfaces of the ridge, eaves and glazing bars are timber clad.

It is envisaged that timber cladding for the conservatory roof system of the invention will be fixed to conventional plastics cladding therefor.

The term "timber" is intended to include not only natural timber but also composite materials made from wood fibres, chips, particles and the like and being treated or covered, such as by veneers, to give the appearance of natural timber.

At the eaves of the conservatory roof system of the invention preferably a timber support trim will be affixed to the eaves structure and a timber fascia board mounted thereon. The timber fascia board will preferably be fixed to underlying plastics cladding by any suitable means.

Under the ridge, a timber board may be affixed to ridge beam plastics cladding by any suitable means. The ridge beam cladding is preferably height adjustable relative to the ridge beam. In one preferred embodiment, an adjustable carriage for the cladding may be mounted on the underside of the ridge beam. Alternatively height adjustment may be provided by the mounting system of the cladding to the carriage allowing height variation.

The timber board may be affixed to the cladding by means of screws or the like through the cladding into the board. Alternatively, screws or the like may be through the board into the cladding, in which case it may be desirable to provide a timber cover for screw holes, which may be a strip to cover along a line of screw heads.

The ridge beam timber cladding may comprise angled side trims that cover around ends of the plastics cladding and a timber board extending onto ends of the side trims.

Glazing bars may have plastics covers that have flat or angled bottom surfaces depending on the situation of the glazing bar. Ideally, timber trim for glazing bars is usable for both situations. Preferably timber trim for glazing bars comprises generally L-section profiles that have meeting ends that enable them to be used at different relative angles, such as by shaping or relieving thereof.

Timber trims for glazing bars may be affixed to plastics covers thereof by any suitable means. Double sided adhesive tape is believed to be particularly suitable for that purpose.

BRIEF DESCRIPTION FO THE SEVERAL VIEWS OF THE DRAWINGS

This invention will now be further described, by way of example only, with reference to the accompanying drawings in which.

Figure 7A:
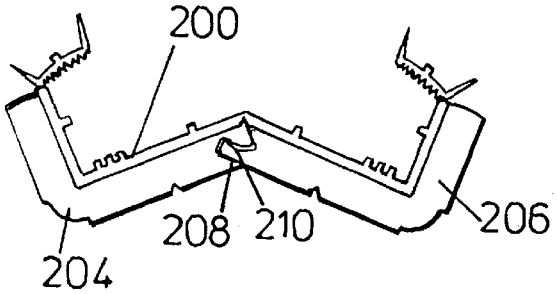
Figure 8A:
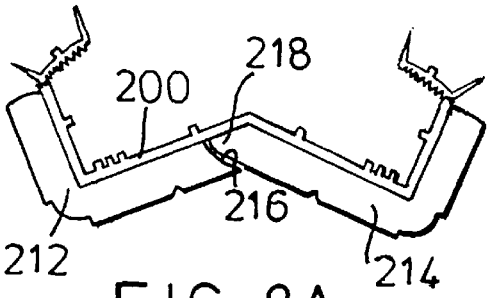
Figure 9:
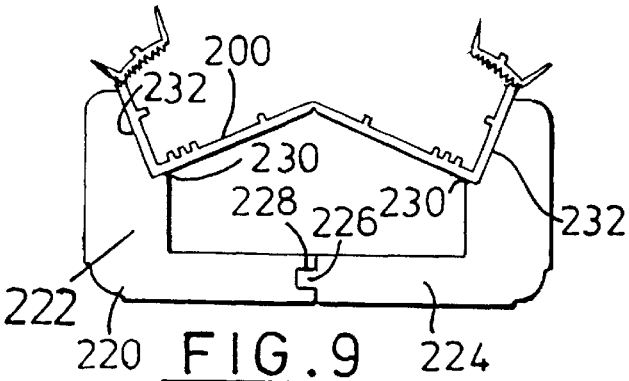
Figure 11A:
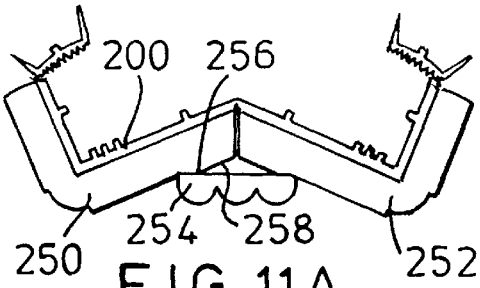
Figure 10:
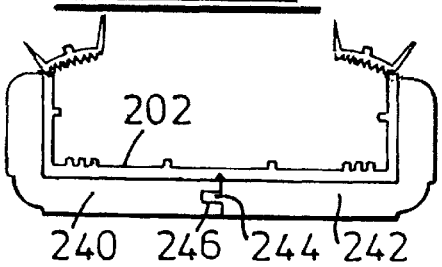
Figure 12A:
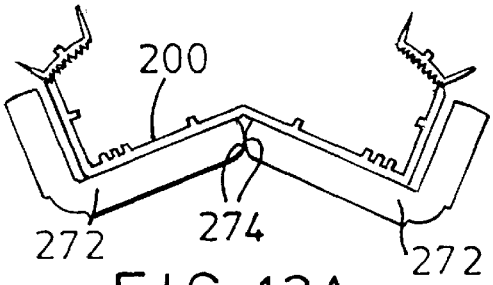
Figure 13A:
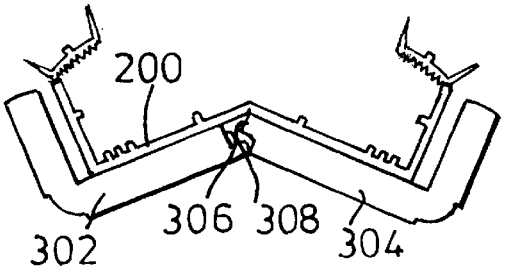
Figure 12B:
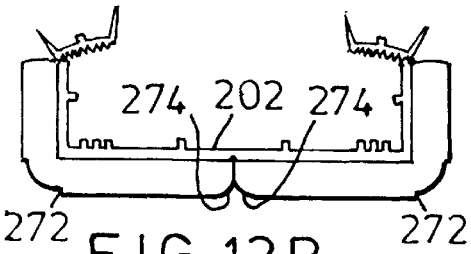
Figure 13B:
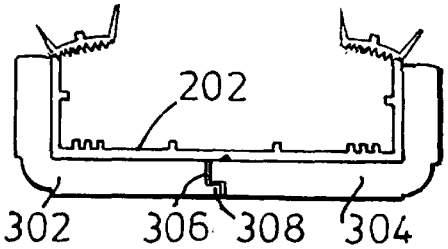
Figure 14:
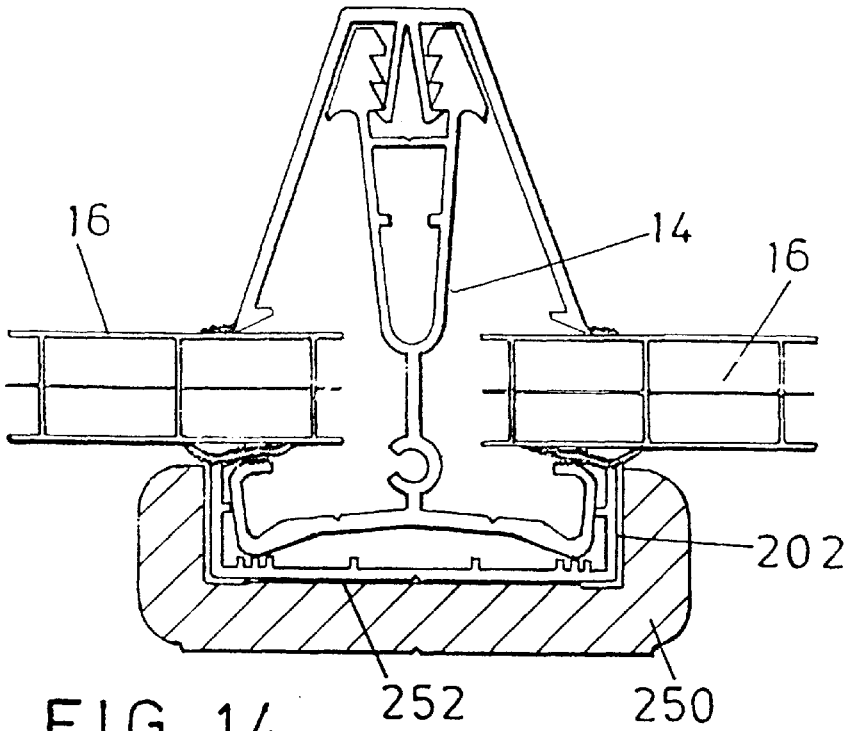

FIGS. 7A and B show a first form of timber cladding for glazing bars;

FIGS. 8A and B show a second form of timber cladding for glazing bars;

FIG. 9 shows a third form of timber cladding for glazing bars;

FIG. 10 shows a fourth form of timber cladding for glazing bars;

FIGS. 11A and B show a fifth form of timber cladding for glazing bars;

FIGS. 12A and B show a sixth form of wooden cladding for glazing bars;

FIGS. 13A and B show a seventh form of timber cladding for glazing bars;

FIG. 14 shows an eighth form of timber cladding for glazing bars; and

Figure 15:
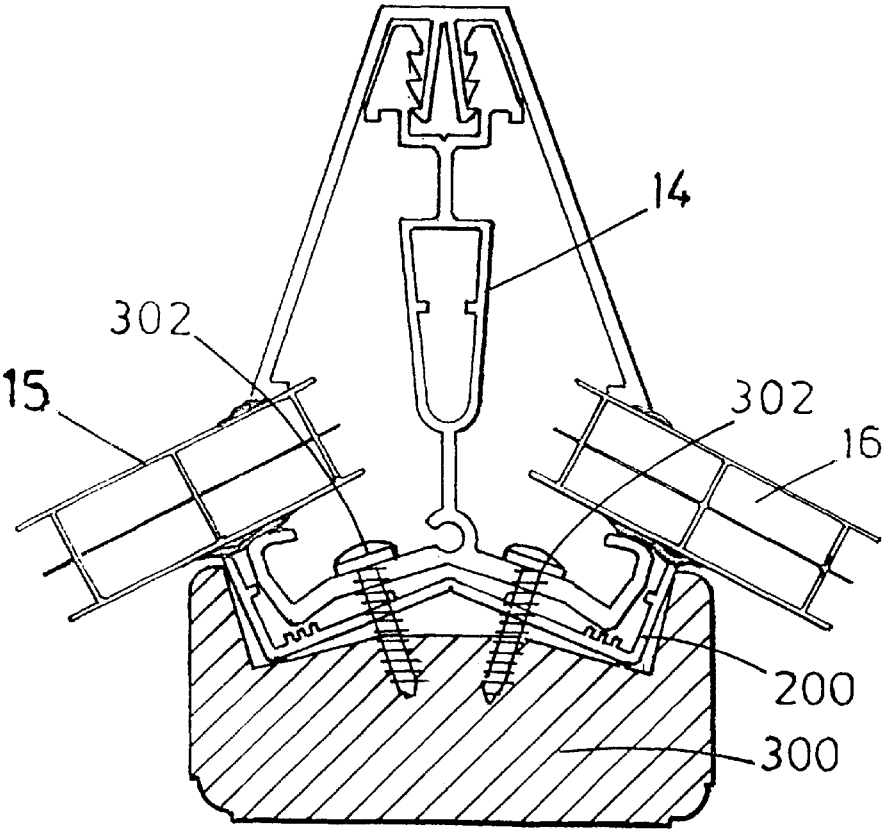

FIG. 15 shows a ninth form of timber cladding for glazing bars.

In the drawings like parts have been given the same reference number that will be used throughout.

DETAIED DESCRIPTION OF THE INVENTION

Figure 1:
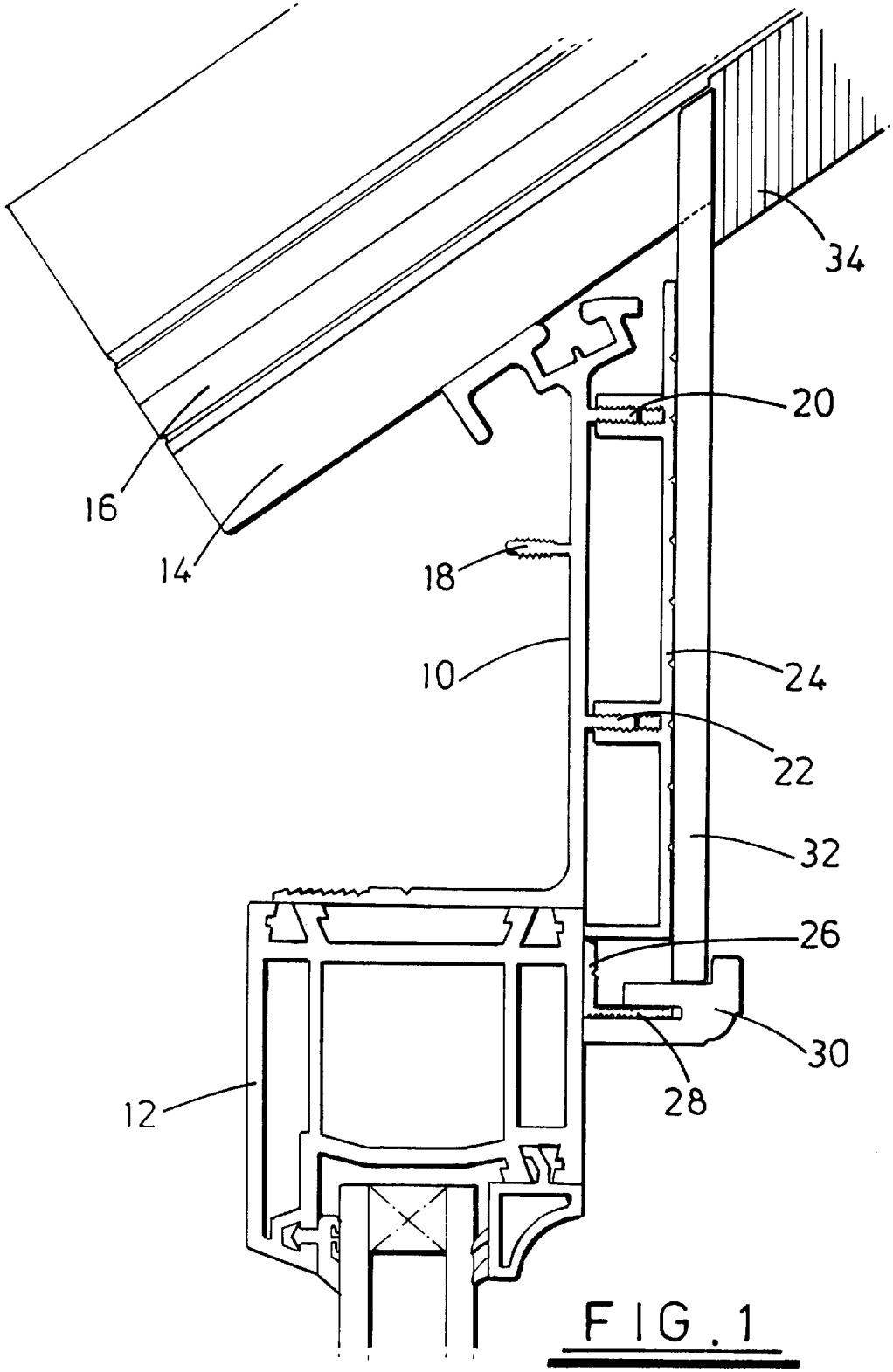
FIG. 1 shows a conservatory roof eaves structure with one form of timber cladding.

Referring to FIG. 1 of the accompanying drawings, a conservatory roof eaves structure comprises an eaves beam 10 mounted on top of window frame 12. At its top the eaves beam supports glazing bars 14 between which are mounted glazing panels 16. On the left as viewed, the eaves beam 10 has a fir-tree type rib 18 to which guttering or guttering brackets are usually connected. On its opposite face, the eaves beam 10 has a pair of fir-tree type ribs 20, 22 onto which is push-fitted plastics cladding 24, which is the conventional finish for a u-PVC/aluminium conservatory roof.

To provide a timber finish to the eaves structure, an L-shaped bracket 26 is screwed to the window frame 12 below the cladding 24. The L-shaped bracket 26 provides a fir-tree type bead 28 onto which is push-fitted a timber support trim 30. The trim 30 supports a timber fascia board 32 that is fixed to the cladding 24 in any suitable way, such as by means of adhesive, double-sided adhesive tape or Velcro (Trade Mark). The timber fascia board 32 is notched to fit around the glazing bars 14. The glazing bars 14 are themselves timber clad internally of the conservatory roof. The cladding 34 is scribed into the timber fascia 32. Examples of suitable timber cladding for glazing bars will be described below.

Figure 2:
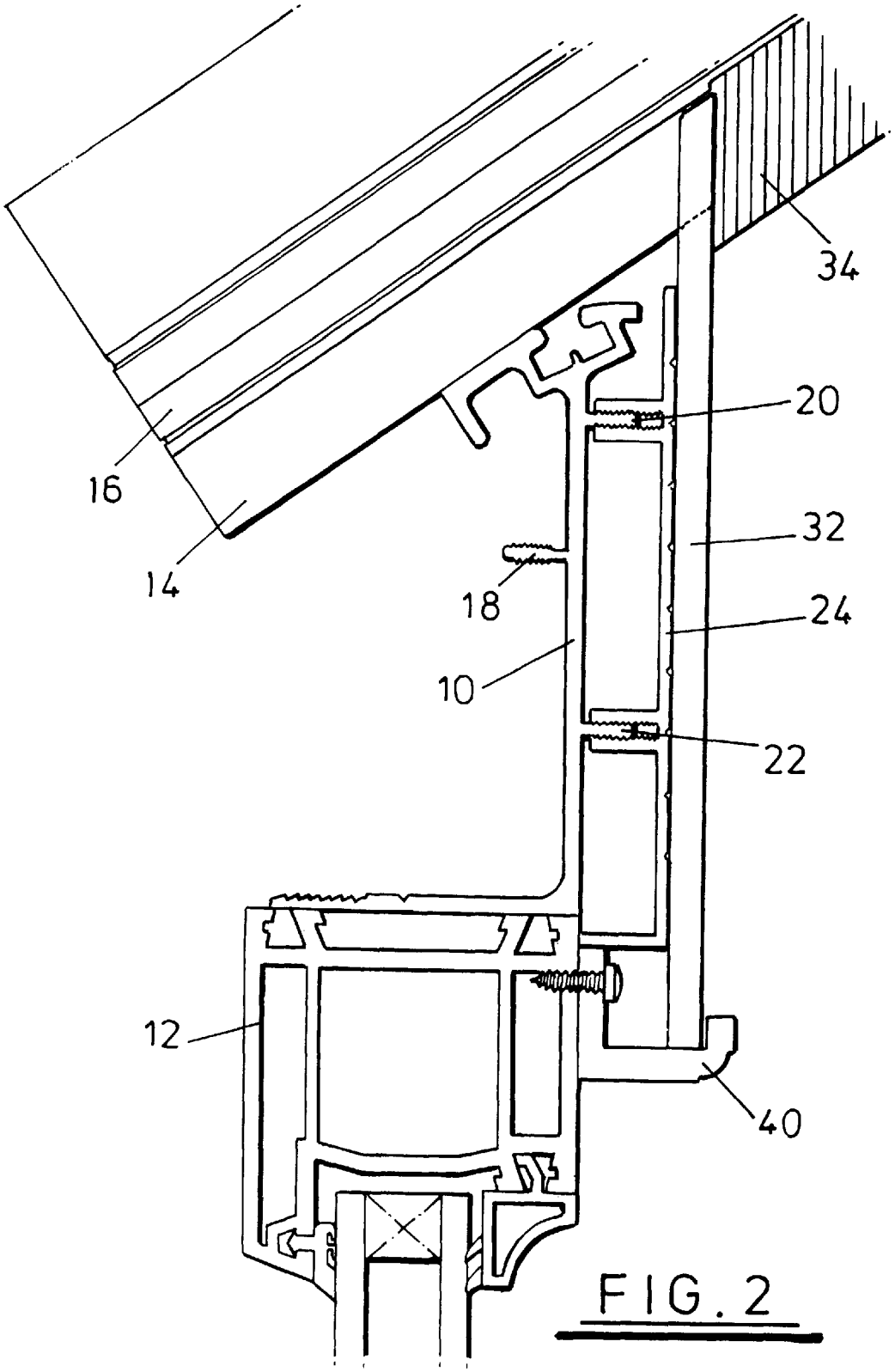
FIG. 2 shows a conservatory roof eaves structure with another form of timber cladding.

FIG. 2 of the accompanying drawings shows an alternative eaves timber cladding system to that of FIG. 1. The basic eaves structure is the same as is the cladding system, except that the timber fascia board support is an L-section timber support 40 screwed directly to the window frame 14.

Figure 3:
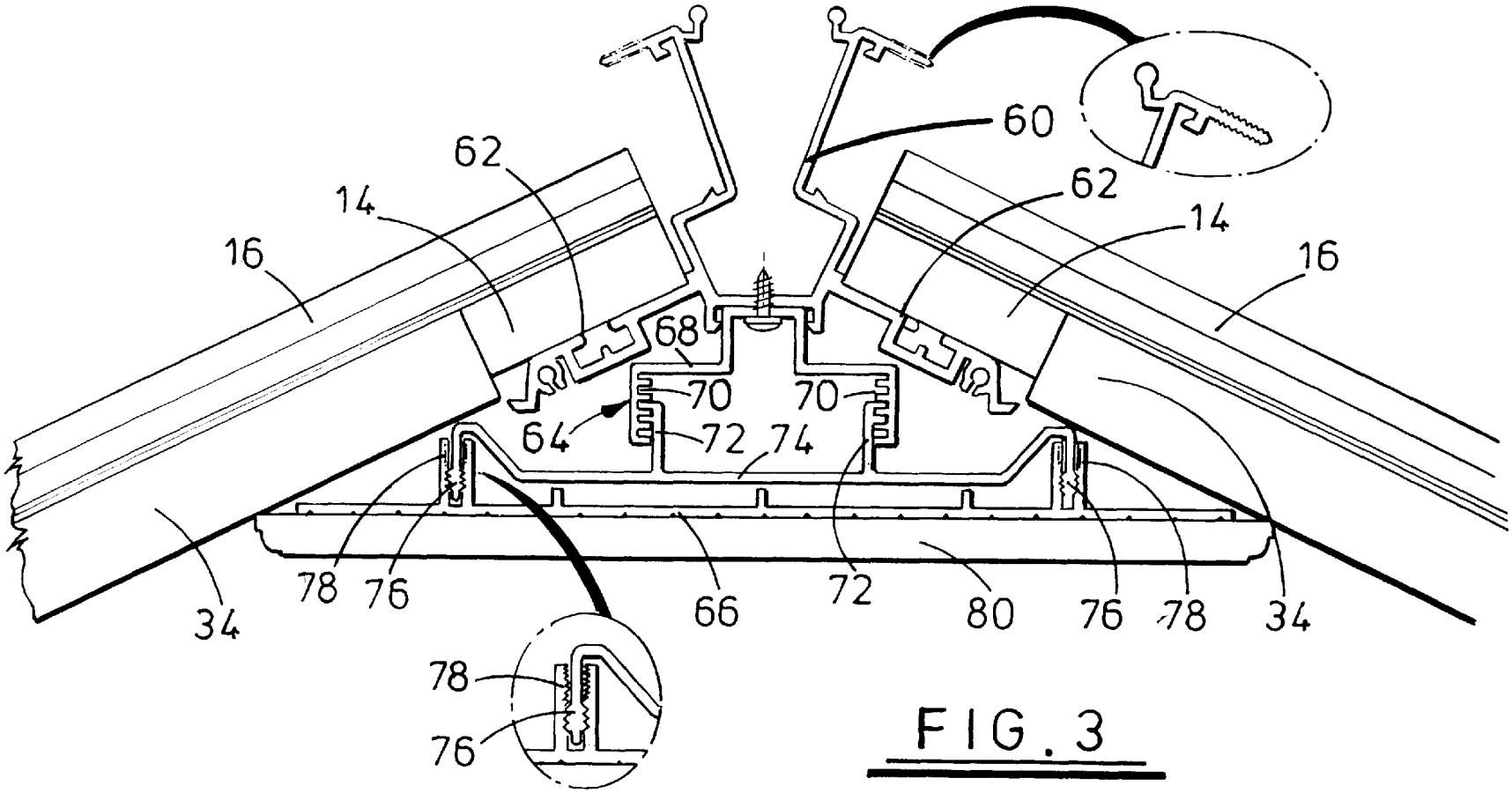
FIG. 3 shows a conservatory roof ridge structure with a first form of timber cladding.

Turning to FIG. 3 of the accompanying drawings, a conservatory roof ridge structure comprises a ridge beam 60 having a pair of sloping flanges 62 extending from opposite sides thereof. Mounted on the flanges are glazing bars 14 supporting glazing panels 16. The glazing bars 14 have timber cladding 34 thereon as will be described later.

Mounted on the underside of the ridge beam 60 is an adjustable carriage 64 which carries a conventional plastics cladding 66. The carriage 64 comprises a channel member 68 having opposed slotted sides 70 to retain outwardly extending ribs of upstanding limbs 72 of a cladding carrier 74 at different relative heights. The cladding carrier 74 has at each end a downwards profiled flange 76 onto which the cladding 66 can be push-fitted because of its corresponding slotted projections 78.

Onto the underside of the cladding 66 is fixed a timber ridge board 80. The timber board 80 is preferably fixed in place by screws through the cladding 66 into the board 80.

By relative adjustment of the two cladding carriage 64 components different roof angles can be accommodated so that the timber ridge board 80 will butt up against the glazing bar cladding at its edges.

Figure 4:
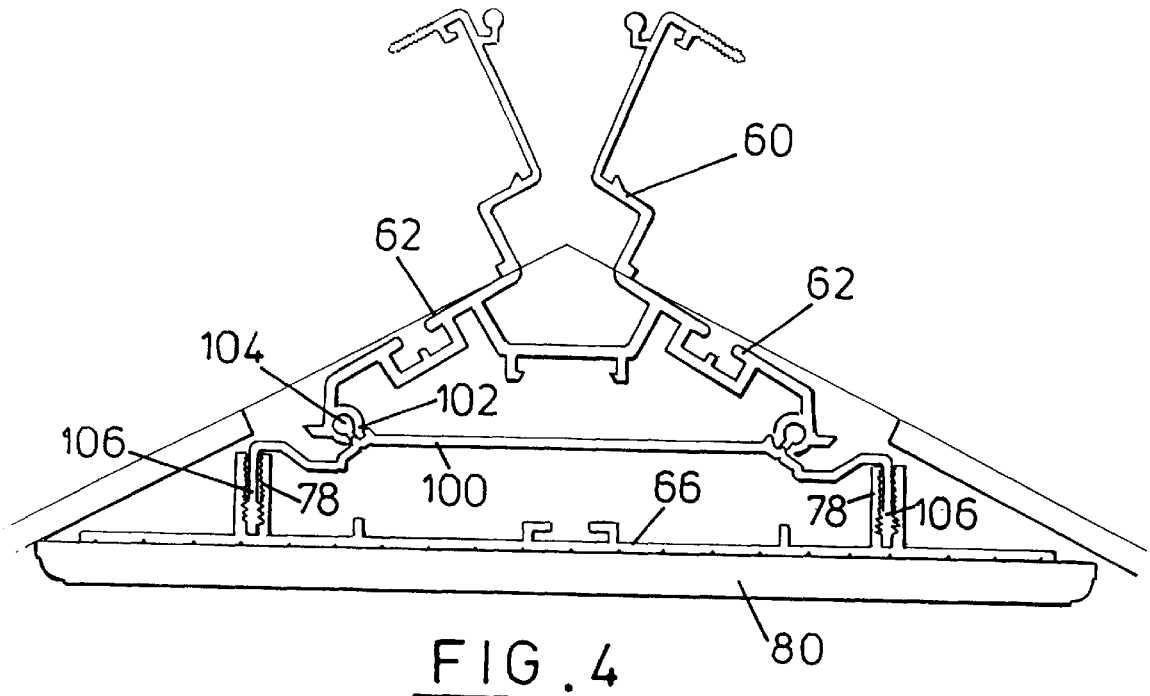
FIG. 4 shows a conservatory roof ridge structure with a second form of timber cladding.

In FIG. 4 of the accompanying drawings an alternative ridge cladding system is shown. In this system, a conventional plastics cladding carriage 100 comprises a panel having a pair of spaced parallel ribs 102 on its top surface that slide into corresponding slots 104 in the ends of the flanges 62 of the ridge beam 60. Ends 106 of the panel 100 are turned downwards and are profiled to fit into the slotted projections 78 of the cladding 66. To the cladding 66 is mounted the ridge board 80. Different roof angles may be accommodated by the extent to which the cladding 66 is pushed onto the carriage 100.

Figure 5:
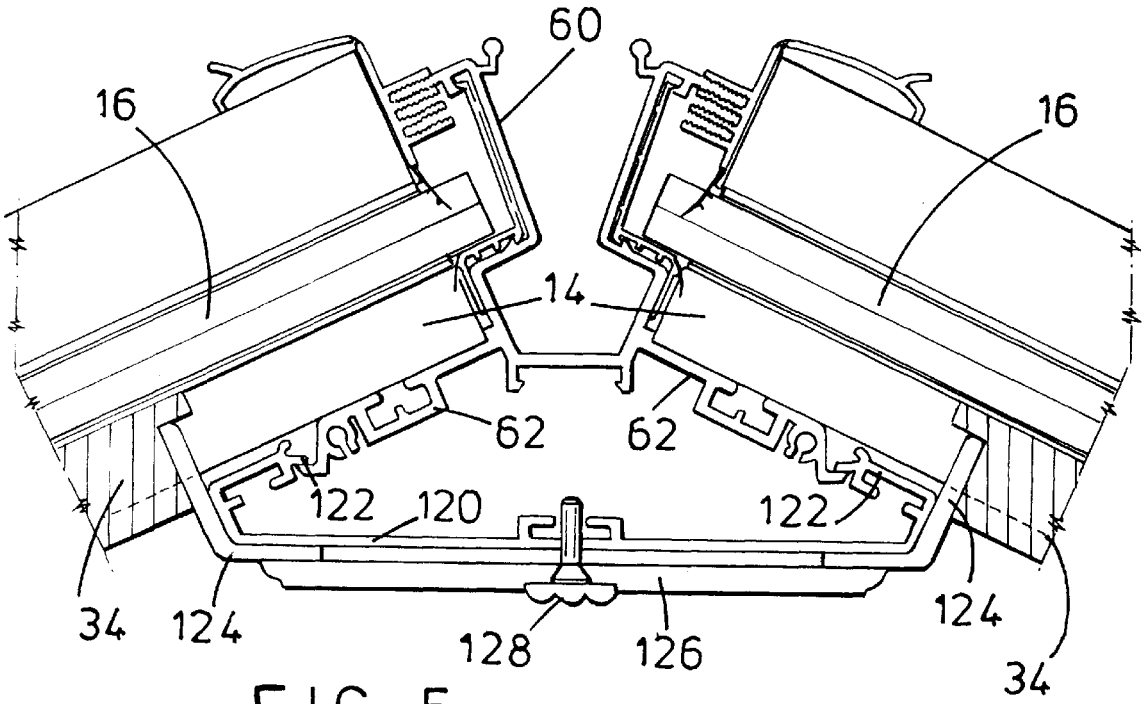
FIG. 5 shows a conservatory roof ridge structure with a third form of timber cladding.

Turning to FIG. 5 of the accompanying drawings, a yet further form of ridge timber cladding is shown. This form makes use of a plastics ridge cladding 120 that has returned ends 122 that clip over ends of the ridge beam flanges 62. Timber cladding for the underside of the ridge comprises end trims 124 that are fixed around sides of the cladding 120 by means of double sided adhesive tape or any other suitable means. The trims 124 are notched to fit around the glazing bars 14 and u-PVC cladding thereon and timber cladding 34 for the glazing bars 14 is scribed into the trims. The trims 124 extend partially around the underside of the cladding 120. A timber ridge board 126 is screw fixed to the cladding 120 covering the ends of the trims 124. The board 126 is channelled along the line of screws and a decorative timber screw cover 128 is fixed in said channel by means of double sided adhesive tape or any other suitable means.

Figure 6:
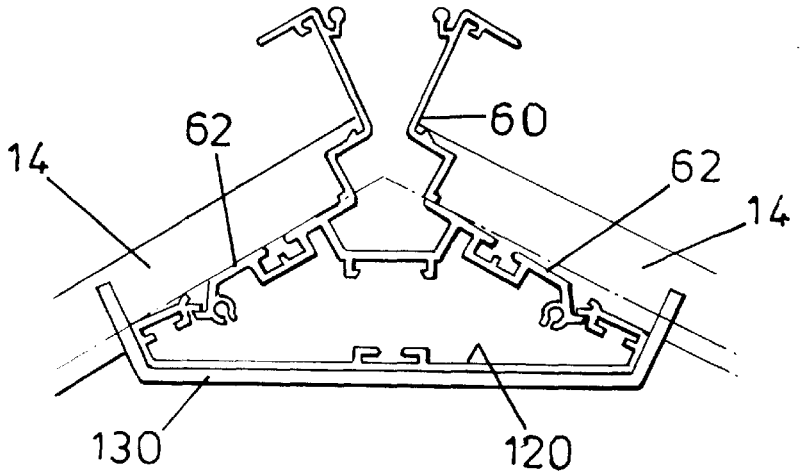
FIG. 6 shows a conservatory roof ridge structure with a fourth form of timber cladding.

FIG. 6 of the accompanying drawings shows a variation on FIG. 5, in which a one piece shaped timber ridge board 130 is fixed to the underside of ridge cladding 120 by screw fixing through the cladding into the board 130 or by any other suitable means, such as double-sided adhesive tape.

Turning now to timber cladding of the glazing bars 14, it is to be noted that in Victorian or Edwardian type conservatory roofs there will be different types of glazing bar undercladding used. Main roof sections will have flat bottomed cladding but at bell ends to the angle of adjacent glazing panels to each other the cladding will have faceted bottom surfaces. Thus, many of the timber trim examples described below have been designed to enable the same trim to be used on different glazing bar claddings. The u-PVC cladding is generally of channel section with inwardly directed co-extruded gaskets along top edges that fit over and retain the cladding on the glazing bar. The timber trims will usually be fixed in position by means of double sided adhesive tape or by any other suitable means.

Figure 7B:
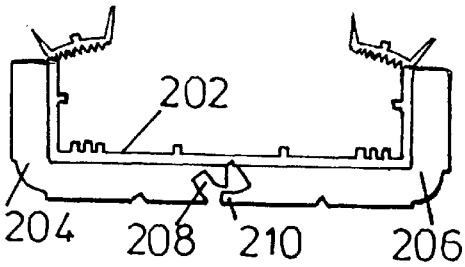
Figure 8B:
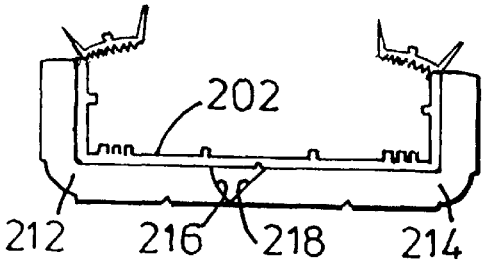

In FIGS. 7A and 7B there is shown respectively a Victorian glazing bar plastics cladding 200 and a conventional glazing bar cladding 202. Timber trim is provided in two parts 204, 206 that are both generally L-shaped in section. Respective edges of the parts 204, 206 have an arcuate groove 208 and a tongue 210 whereby the two parts can interfit and be angle adjusted as shown in FIG. 7A. In FIG. 7B the two timber parts 204, 206 do not interfit but present a substantially continuous appearance from below.

In FIGS. 8A and B, timber trims 212, 214 for glazing bar claddings are shown. One edge 216 of the trim 212 is arcuate and cooperating edge 218 of trim 214 is mitred. Thus, the two trims can be used on faceted cladding and flat cladding.

FIG. 9 shows timber trim 220 for a faceted cladding 200 to give the appearance of a flat bottomed cladding. The timber trim comprises two L-section members 222, 224 one having a tongue 226 and the other a groove 228 at meeting edges whereby the two trims interfit. Internally of each trim a ledge 230 is formed with a sloping back 232 on which the cladding 200 sits.

FIG. 10 of the drawings shows the corresponding timber trim for a flat bottomed plastics cladding 202. The trim comprises two L-section components 240, 242 that interfit by means of tongue and groove formations 244, 246 respectively.

Figure 11B:
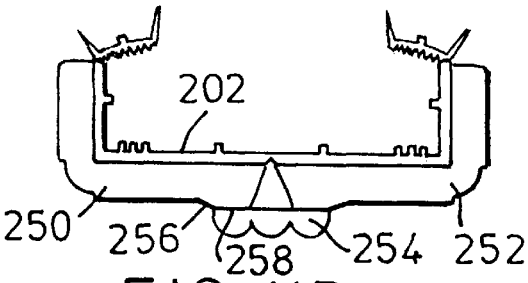

In FIGS. 11A and 11B timber trims for both types of glazing bar cladding 200 and 202 comprises two L-section profiles 250, 252 and a cover strip 254. The profiles 250, 252 have angled ends that on an angled cladding 200 abut each other but leave a gap when on the cladding 202. The underside of each trim near its angled ends has two facets, the first 256 is angled and the other is 258 is parallel to the remainder of the underside of the trim. The angle of the facets 256 has been chosen, so that on a faceted cladding 200, they are in line to provide a mounting surface for the cover strip 254.

When the trim is on cladding 202 (FIG. 11B) the facets 258 provide a mounting surface for the cover strip 254.

In FIGS. 12A and B, timber trim comprises identical L-section profiles 272 whose meeting ends 274 are rounded, so that the two trims can be fitted at different angles to each other depending on the cladding to which they are fixed.

In FIGS. 13A and B, timber trim comprises two profiles 302, 304 which are oppositely rebated at their meeting ends 306, 308, so that on a flat cladding 202, the rebates fit together, whereas on an angled cladding 200 the rebates allow the profiles to meet at their bottom edges.

FIG. 14 of the accompanying drawings shows a simple channel section timber cover 250 for a glazing bar. The cover 250 is fixed onto the u-PVC cladding 202 by means of double sided adhesive tape 252. Adhesive can be used as an alternative.

Finally in FIG. 15 of the accompanying drawings, a channel section timber cover 300 is fixed to angled u-PVC cladding 200 on glazing bar 14. The channel is shaped to accommodate the cladding by having outwardly sloping sides and a base that slopes upwardly from each side to a central plateau. Screws 302 through the glazing bar and the cladding into the timber cover are used to fix the timber cover in place.

Thus, the present invention provides various ways, in which a conventionally u-PVC cladded conservatory roof can be given an internal appearance of being constructed from timber.

What is claimed is:

1. A conservatory roofing system comprising a ridge, eaves and glazing bars supporting glazing material between the ridge and eaves, the ridge, eaves and glazing bars comprising structural members of aluminum having internal and external surfaces relative to the roof and plastics cladding components on the internal surfaces thereof, wherein at least one internal surfaces of the at least one of the ridge, eaves and glazing bars is timber clad, the timber cladding being applied to the components of plastics material.

2. A system as claimed in claim 1, wherein a timber support trim is affixed to the eaves and a timber fascia board mounted on the support trim.

3. A system as claimed in claim 2, wherein the timber fascia board is fixed to the plastic cladding component.

4. A system as claimed in claim 1, wherein a ridge beam plastic cladding component is operably fixed to the ridge and eaves, and under the ridge, a timber board is affixed to the ridge beam plastic cladding component, forming a ridge beam cladding.

5. A system as claimed in claim 4, wherein the ridge beam cladding is height adjustable relative to the ridge beam.

6. A system as claimed in claim 5, wherein an adjustable carriage for the ridge beam cladding is mounted on the ridge beam underside.

7. A system as claimed in claim 1, wherein timber cladding for glazing bars comprises generally L-section profiles that have meeting ends enabling them to be combined at different relative angles.

8. A conservatory roofing system comprising a ridge, eaves and glazing bars supporting glazing material between the ridge and eaves, the ridge, eaves and glazing bars comprising structural members of aluminum having internal and external surfaces relative to the roof and plastics cladding components on the internal surfaces thereof, wherein at least one internal surfaces of the at least one of the ridge, eaves and glazing bars is timber clad, the timber cladding being applied to the components of plastics material and wherein the timber cladding for the glazing bars comprises generally L-section profiles that have meeting ends enabling the timber cladding to be combined at different relative angles.

9. A system as claimed in claim 8, wherein a timber support trim is affixed to the eaves and a timber fascia board is mounted on the support trim.

10. A system as claimed in claim 9, wherein the timber fascia board is fixed to the plastic cladding component.

11. A system as claimed in claim 8, wherein a ridge beam plastic cladding component is operably fixed to the ridge and eaves, and under the ridge, a timber board is affixed to the ridge beam plastic cladding component forming a ridge beam cladding.

12. A system as claimed in claim 11, wherein the ridge beam plastic cladding is height adjustable relative to the ridge beam.

13. A system as claimed in claim 12, wherein an adjustable carriage for the ridge beam cladding is mounted on the ridge beam underside.

* * * * *